US007712625B2

(12) United States Patent
Alger

(10) Patent No.: US 7,712,625 B2
(45) Date of Patent: May 11, 2010

(54) COOLING COASTER FOR BEVERAGE CONTAINER

(76) Inventor: Ann Mary Alger, 8516 Bound Brook La., Alexandria, VA (US) 22309

( * ) Notice: Subject to any disclaimer, the term of this patent is extended or adjusted under 35 U.S.C. 154(b) by 329 days.

(21) Appl. No.: 11/934,572

(22) Filed: Nov. 2, 2007

(65) Prior Publication Data

US 2009/0114791 A1 May 7, 2009

(51) Int. Cl.
*B65D 25/00* (2006.01)

(52) U.S. Cl. ..... 220/737; 220/666

(58) Field of Classification Search ..... 220/629, 220/666, 737, 739
See application file for complete search history.

(56) References Cited

U.S. PATENT DOCUMENTS

| | | | | |
|---|---|---|---|---|
| 1,891,077 | A | | 12/1932 | Beach |
| 2,655,281 | A | * | 10/1953 | Davis ..... 215/394 |
| 2,727,645 | A | | 12/1955 | Dore |
| 2,926,508 | A | | 3/1960 | Moon |
| 2,929,526 | A | | 3/1960 | Steinberg |
| 2,990,968 | A | | 7/1961 | Pirman |
| 3,285,455 | A | | 11/1966 | Pewitt |
| 3,285,456 | A | | 11/1966 | Pewitt |
| 3,603,106 | A | | 9/1971 | Ryan |
| 3,757,852 | A | | 9/1973 | Allinger |
| 4,163,374 | A | | 8/1979 | Moore et al. |
| 4,383,422 | A | | 5/1983 | Gordon et al. |
| 4,485,636 | A | | 12/1984 | Hilado |
| 4,681,239 | A | * | 7/1987 | Manns et al. ..... 220/592.16 |
| 4,720,023 | A | | 1/1988 | Jeff |
| 4,745,776 | A | | 5/1988 | Clark |
| 4,889,302 | A | | 12/1989 | Tucker |
| 4,989,415 | A | | 2/1991 | Lombness |
| 5,022,549 | A | | 6/1991 | Beaver |
| 5,067,329 | A | | 11/1991 | Tomlinson |
| 5,090,213 | A | | 2/1992 | Glassman |
| 5,212,963 | A | | 5/1993 | McGinnis |
| 5,575,398 | A | * | 11/1996 | Robbins, III ..... 220/8 |
| D378,795 | S | | 4/1997 | King |
| 5,653,124 | A | | 8/1997 | Weber |
| 6,398,061 | B2 | | 6/2002 | Duff et al. |
| 6,516,548 | B2 | | 2/2003 | Lage et al. |
| 6,516,967 | B2 | | 2/2003 | Duff et al. |
| 6,588,621 | B2 | | 7/2003 | Shimazaki |

(Continued)

*Primary Examiner*—Anthony Stashick
*Assistant Examiner*—Harry A Grosso
(74) *Attorney, Agent, or Firm*—Law Office of Peter G. Korytnyk, PLLC

(57) ABSTRACT

A cooling coaster device and method for supporting and keeping a cold beverage container cool are provided. The cooling coaster device can include a relatively short, cup-shaped body including a closed bottom and a cylindrical sidewall forming an opening at an end thereof. A sealing ring gasket is integrally formed with the cylindrical sidewall in a vicinity of the opening. The sealing ring gasket can form a narrowest portion of the cup-shaped body and can be capable of forming a water and gas-tight seal when a beverage container is inserted into the cup-shaped body. The cooling coaster device can include a support extending into an interior of the cup-shaped body and forms a stop surface arranged a set distance from the closed bottom. The cooling coaster can be formed as an integral, one-piece structure and can keep the cold beverage container cool while not concealing its labeling and preventing the formation of a condensation ring.

17 Claims, 6 Drawing Sheets

U.S. PATENT DOCUMENTS

| | | | | |
|---|---|---|---|---|
| 6,786,062 | B1 | 9/2004 | Greenberg | |
| D498,392 | S | 11/2004 | Lowe | |
| D504,285 | S | 4/2005 | Lowe | |
| 7,051,730 | B2 | 5/2006 | Lin | |
| D523,293 | S | 6/2006 | Disbrow et al. | |
| 7,118,005 | B2 * | 10/2006 | Shimazaki | 220/737 |
| 7,124,603 | B2 | 10/2006 | Bianco | |
| 7,124,604 | B2 | 10/2006 | Taylor et al. | |
| 7,201,285 | B2 | 4/2007 | Beggins | |
| 2002/0121104 | A1 | 9/2002 | Duff et al. | |
| 2003/0146227 | A1 | 8/2003 | Shimazaki | |
| 2006/0043250 | A1 | 3/2006 | Farrell | |
| 2006/0075770 | A1 | 4/2006 | Lefkowitz et al. | |

* cited by examiner

COOLING COASTER FOR BEVERAGE CONTAINER

FIELD OF THE INVENTION

The present teachings relate to a device and method for keeping a cold beverage container cool for extended periods of time. In particular, the present teachings relate to a cooling coaster that keeps a cold beverage container cool while not concealing the labeling on the container or allowing the formation of a condensation ring on a resting surface.

BACKGROUND OF THE INVENTION

Coasters used under beverage containers operate by receiving and/or trapping condensation which forms on the exterior of such containers and drains down their sides onto the coaster. In this manner, coasters prevent moisture from reaching a table top or other surface on which the beverage container is positioned. However, such conventional coasters do not provide a cooling function.

Known holders for keeping beverage containers cool include insulated cups having thermally insulated walls. These holders keep the beverage container hot or cool by covering all or a majority of the sidewalls of the beverage container thereby insulating the beverage container from ambient conditions. However, such beverage container coolers or insulators are of a height that cover-up or conceal the labeling or graphics on the beverage container and preclude users from directly grasping the beverage container.

Accordingly, there exists a need for a holder for a beverage container that keeps a cold beverage cool for extended periods of time while not concealing the labeling or graphics on the beverage container. There also exists a need for such a beverage container holder which includes condensation control like a coaster and prevents the likelihood of the formation of a condensation ring during use.

SUMMARY OF THE INVENTION

The present teachings provide a cooling coaster including a cup-shaped body having a closed bottom and a cylindrical sidewall forming an opening at a top end thereof. A sealing ring gasket can be arranged in the cylindrical sidewall of the cup-shaped body in a vicinity of the opening. A support pedestal can be provided that extends from the closed bottom into an interior of the cup-shaped body. A distal end of the support pedestal forms a stop surface. A distance from the stop surface of the support pedestal to the opening at the top end of the cup-shaped body can be about 2 inches or less.

The present teachings further describe a cooling coaster including a cup-shaped body having a closed bottom and a cylindrical sidewall forming an opening at an end thereof. A sealing ring gasket can be integrally formed with the cylindrical sidewall in a vicinity of the opening. The sealing ring gasket can form a narrowest portion of the cup-shaped body and can be capable of forming a water and gas-tight seal when a beverage container is inserted into the cup-shaped body. A distance corresponding to a height of the cooling coaster as measured from the closed bottom to the opening at the end of the cylindrical sidewall can be about 3 inches or less.

The present teachings still further describe a cooling coaster including a cup-shaped body having a closed bottom and a cylindrical sidewall forming an opening at a top end thereof. A sealing ring gasket can be arranged in the cylindrical sidewall in a vicinity of the opening. A support pedestal can extend from the closed bottom into an interior of the cup-shaped body. A distal end of the support pedestal can form a stop surface. At least one of the cylindrical sidewall and the support pedestal can include a collapsible fold.

The present teachings also describe a method of supporting and keeping a cold beverage container cool. The method includes providing a cooling coaster comprising a cup-shaped body including a closed bottom and a cylindrical sidewall forming an opening at an end thereof, a sealing ring gasket integrally formed with the cylindrical sidewall in a vicinity of the opening and forming a narrowest portion of the cup-shaped body, and a support extending into an interior of the cup-shaped body and having a stop surface. The method includes introducing a coolant into an area below the stop surface of the support. The method further includes inserting the beverage container into the opening of the cup-shaped body until a bottom portion of the beverage container abuts at least one of the stop surface of the support and the coolant, thereby forming a water and gas-tight seal by way of the sealing ring gasket between the cup-shaped body and the beverage container, the cup-shaped body being sized such that a majority of any labeling on the beverage container is not concealed.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1:
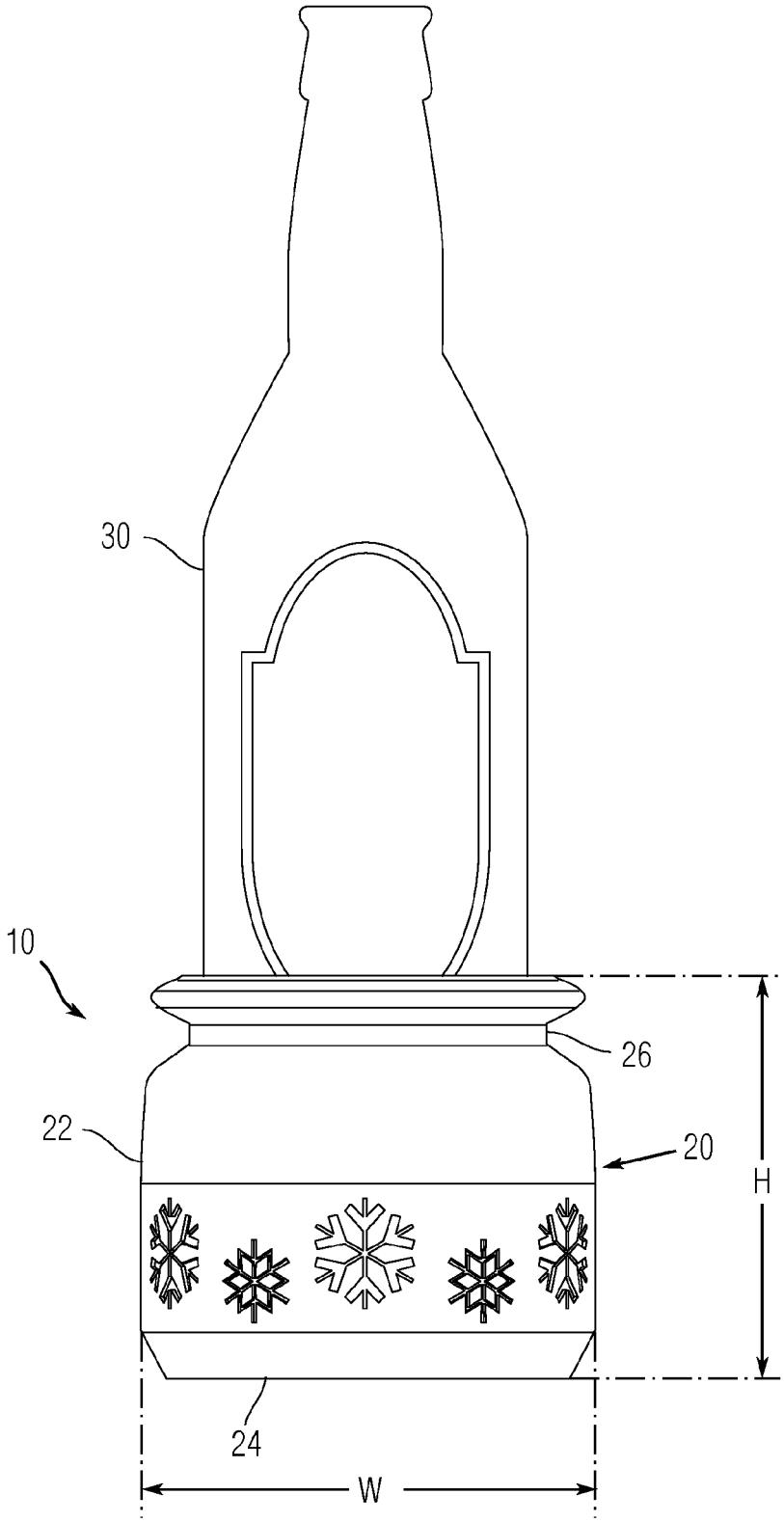
FIG. 1 is a side view of the cooling coaster according to various embodiments with a 12-ounce bottle inserted therein.
Figure 2:
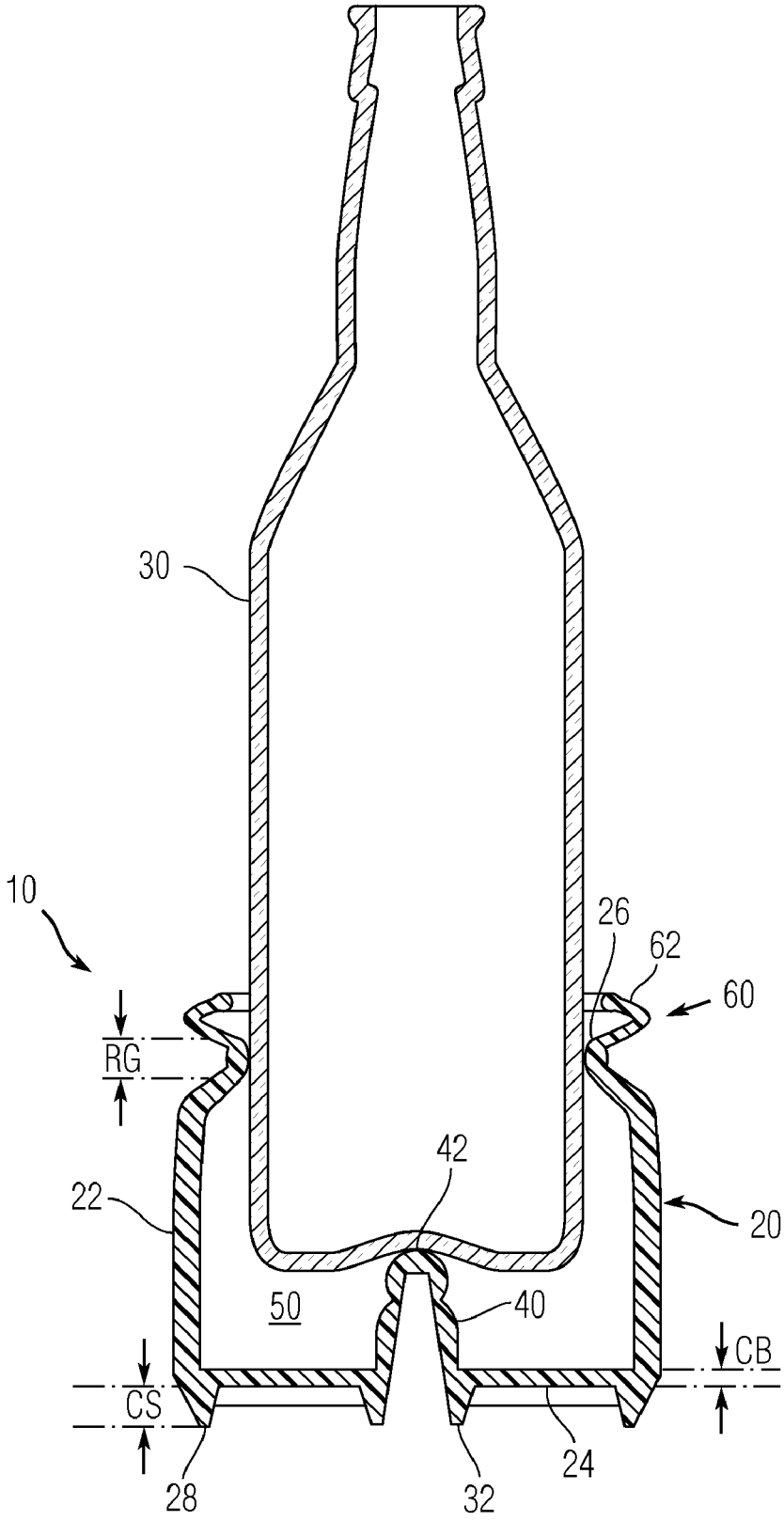
FIG. 2 is a cross-sectional side view of the cooling coaster of FIG. 1.
Figure 3:
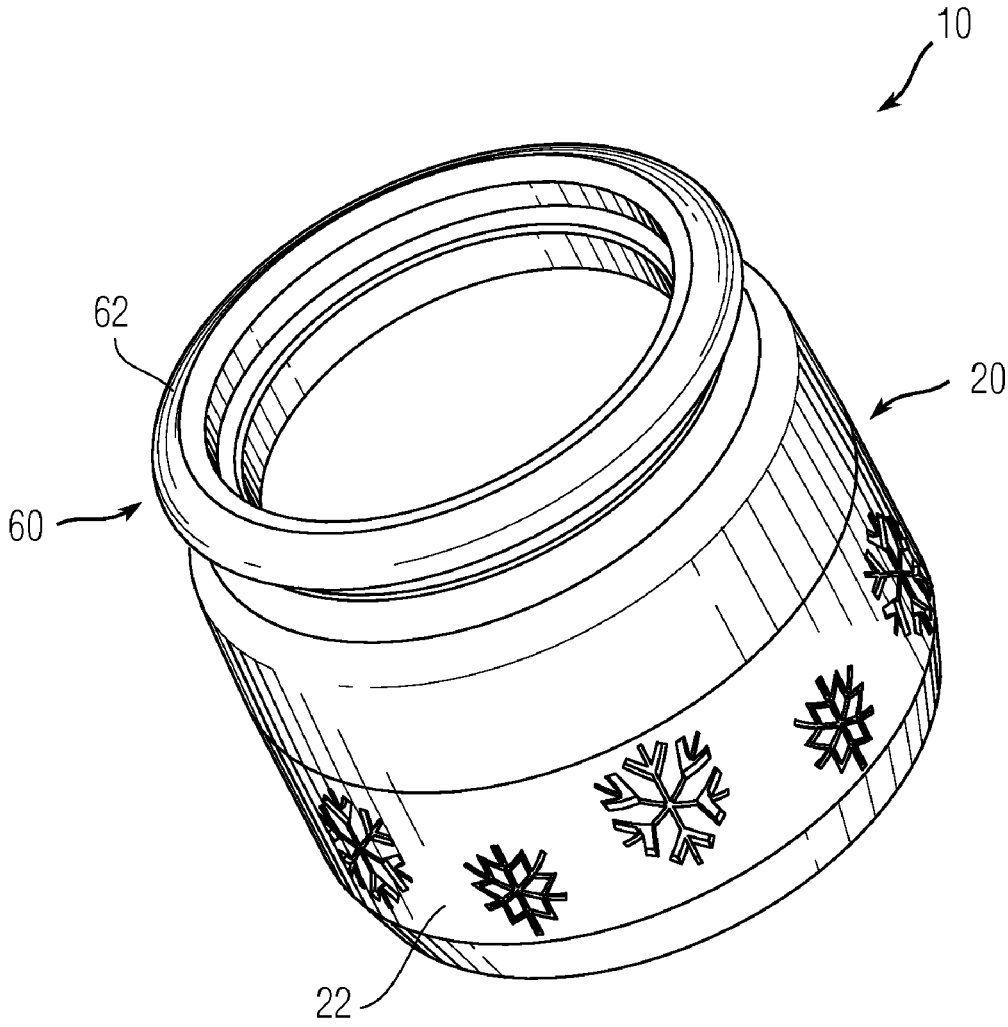
FIG. 3 is a perspective view of the top portion of the cooling coaster according to various embodiments.

Referring to FIGS. 1 and 2, a cooling coaster 10 according to the present teachings is shown as it might be used to keep a typical 12-ounce bottle 30 cool. The cooling coaster 10 can include a relatively shallow cup-like body 20. The cup-like body 20 can form a hollow tube including a generally cylindrical sidewall 22 having an open top and a closed bottom 24. The cooling coaster 10 is adapted to removably receive and firmly grip and support the bottom and sides of a beverage container 30 while keeping from a majority to the entirety of any labeling on the beverage container exposed. The cooling coaster 10 of the present teachings can be adapted to receive various-sized beverage containers 30 such as, for example, cans, bottles, drinking glasses, and the like. More particularly, the cooling coaster 10 can be adapted to receive beverage containers 30 having various cross-sections, such as round, oval, generally square, generally rectangular, and the like. Such bottles can include liquid medicine bottles that require refrigeration during storage and should remain chilled during dispensing while keeping their labeling exposed to the user.

As shown in FIG. 2, the cylindrical sidewall 22 of the cooling coaster 10 can be integrally formed with a sealing ring gasket 26. The sealing ring gasket 26 forms a water and gas-tight seal between the sidewall 22 of the cup-like body 20 and the beverage container 30 when the beverage container 30 is inserted into the cooling coaster 10. The sealing ring gasket 26 serves to help hold the beverage container 30 within the cooling coaster 10 and prevents ice and water from escaping as the cooling coaster 10 is tipped during drinking from the beverage container 30. The water and gas-tight seal formed by the ring gasket 26 allows the formation of a vacuum within a coolant compartment 50 defined between an interior portion of the cup-like body 20 and the inserted beverage container 30.

The closed bottom 24 of the cup-like body 20 can be formed with a support 40 on an interior side thereof. The support 40 can be a pedestal that can extend substantially upwardly a set distance from the closed bottom 24 into the interior of the cup-like body 20. The distal end of the pedestal 40 forms a support surface 42. The pedestal 40 can act as a support and an insertion limit for the bottom or inserted end of the beverage container 30. Being the uppermost extent of the pedestal 40, the support surface 42 is arranged below the sealing ring gasket 26 to allow the sealing ring gasket 26 to form a seal between the beverage container 30 and the cooling coaster 10. As a result, the pedestal 40, sidewall 22, closed bottom 24, and the sealing ring gasket 26 can define a coolant compartment 50 which can be vacuum-sealed when a bottom portion of the beverage container 30 is inserted into the cooling coaster 10. The support surface 42 of the pedestal 40 can also act as a visual indicator to indicate to users the maximum height for the introduction of coolant into the coolant compartment 50.

The pedestal 40 can preferably extend from a substantially middle portion of the closed bottom 24. However, the pedestal 40 can extend from any portion of the closed bottom 24. The pedestal 40 can be a solid structure or can have a hollow interior. According to various embodiments, the pedestal 40 could include a plurality of upwardly extending pedestals 40. Moreover, one or more pedestals 40 can be arranged to extend generally upwardly independently of the sidewall 22 or as integral structures in structural communication with the sidewall 22.

Figure 5:
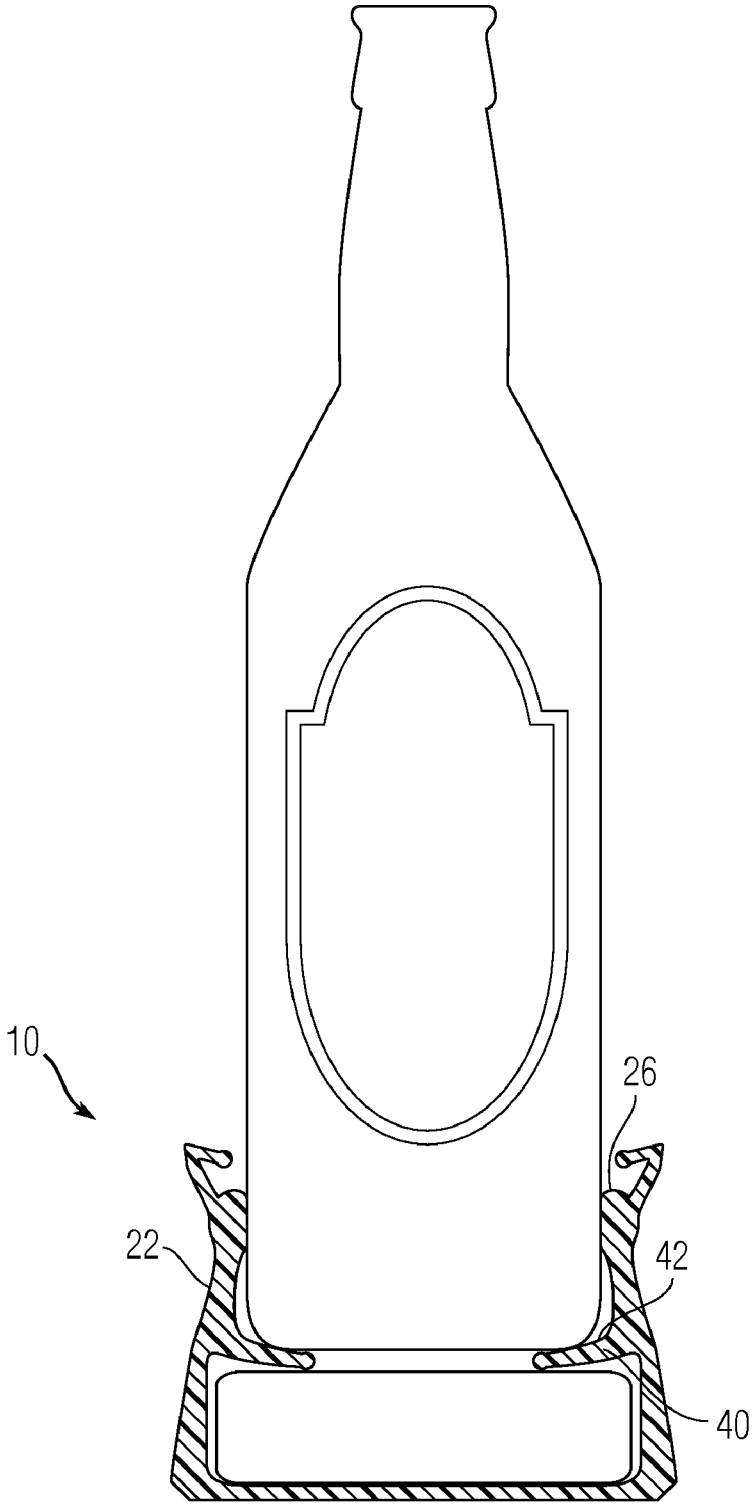
FIG. 5 is a cross-sectional side view of another embodiment of the cooling coaster of the present teachings.

Referring to FIG. 5, the support 40 of the cooling coaster 10 can alternatively be a shelf that extends radially inwardly from the cylindrical sidewall 22. The top surface of the shelf can form a stop surface 42. The shelf 40 can extend below the sealing ring gasket 26 so that the stop surface 42 can provide a support and an insertion limit for the bottom of the inserted beverage container 30. According to various embodiments, the shelf 40 can extend circumferentially around the entire inside circumference of the cylindrical sidewall 22. Alternatively, the shelf can extend around less than the entire circumference of the cylindrical sidewall 22. The coolant compartment 50 is formed below the shelf.

According to various embodiments, the cooling coaster 10 can be arranged without a support 40.

Referring back to FIG. 2, above the sealing ring gasket 26 and at the open top of the cup-like body 20, a condensation control rim 60 can be formed. The condensation control rim 60 can catch and trap condensation that drips down the sides of the inserted beverage container 30. The condensation control rim 60 can include a lip or drip edge 62 that can extend radially inwardly from a top portion of the sidewall 22. The lip or drip edge 62 can extend radially inwardly in an upwardly or downwardly angled direction, or in a direction substantially parallel with a resting surface. The lip or drip edge 62 thereby forms a catch where condensation that has run down the sides of the beverage container 30 can be held. The lip or drip edge 62 prevents the condensation from dripping out when the cooling coaster 10 and secured beverage container 30 are tipped during the consumption of the cooled beverage. The condensation control rim 60 also operates to help prevent the formation of a ring of condensation on the resting surface.

Figure 4:
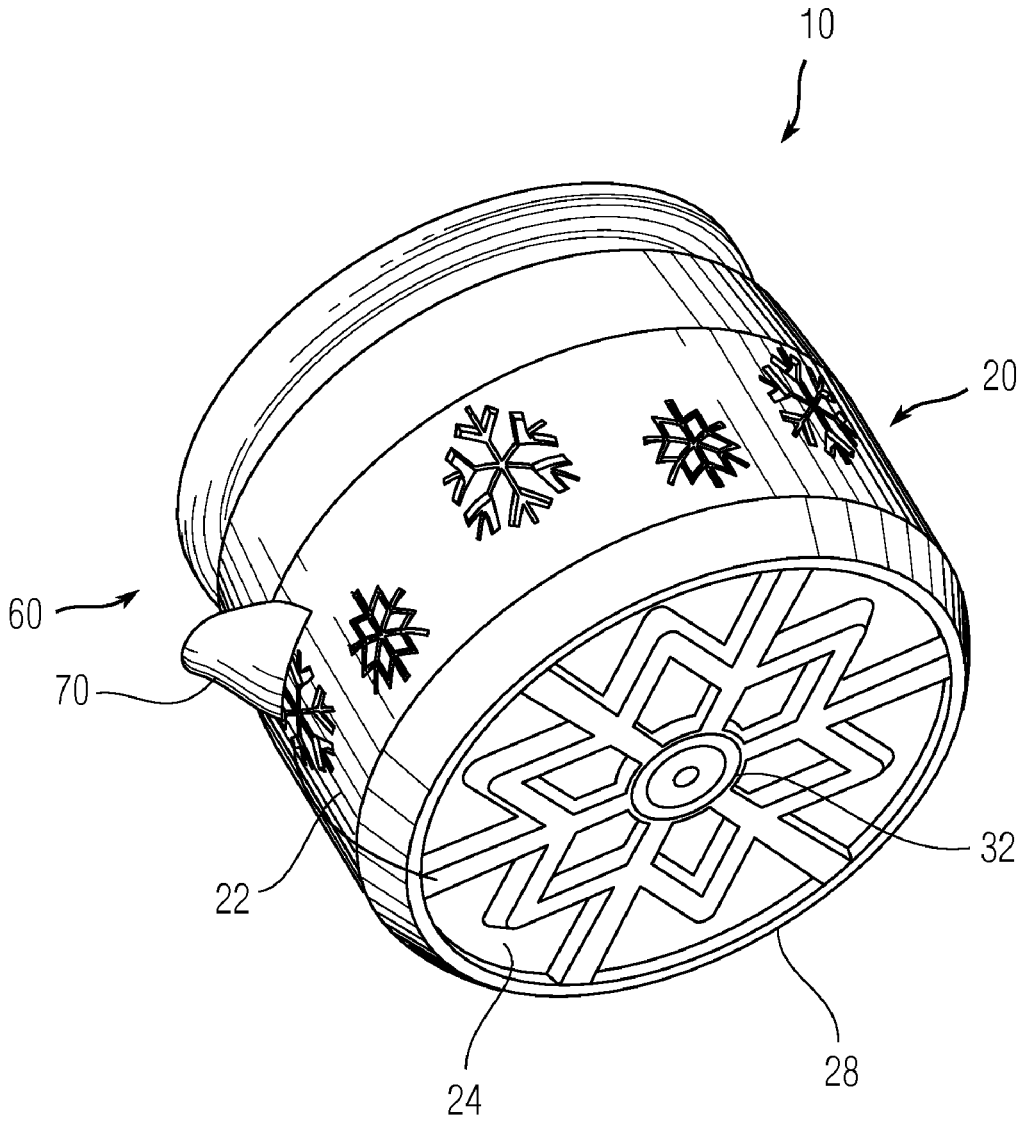
FIG. 4 is a perspective view of the bottom portion of the cooling coaster according to various embodiments.

As shown in FIGS. 2 and 4, the exterior portion of the closed bottom 24 of the cup-like body 20 can be concave in shape in order to limit the surface area that is in contact with a resting surface. For example, as shown in FIG. 2, the closed bottom 24 can be formed with a circumferential bottom edge 28 which operates to elevate the closed bottom from a resting surface. Reducing the area of the cooling coaster 10 that is in contact with a resting surface allows less energy or heat transference to occur between the resting surface and the cooling coaster 10. According to various embodiments, the closed bottom 24 can be formed with a further circumferential bottom edge 32 below the support 40 to provide additional support for the closed bottom 24.

Figure 6:
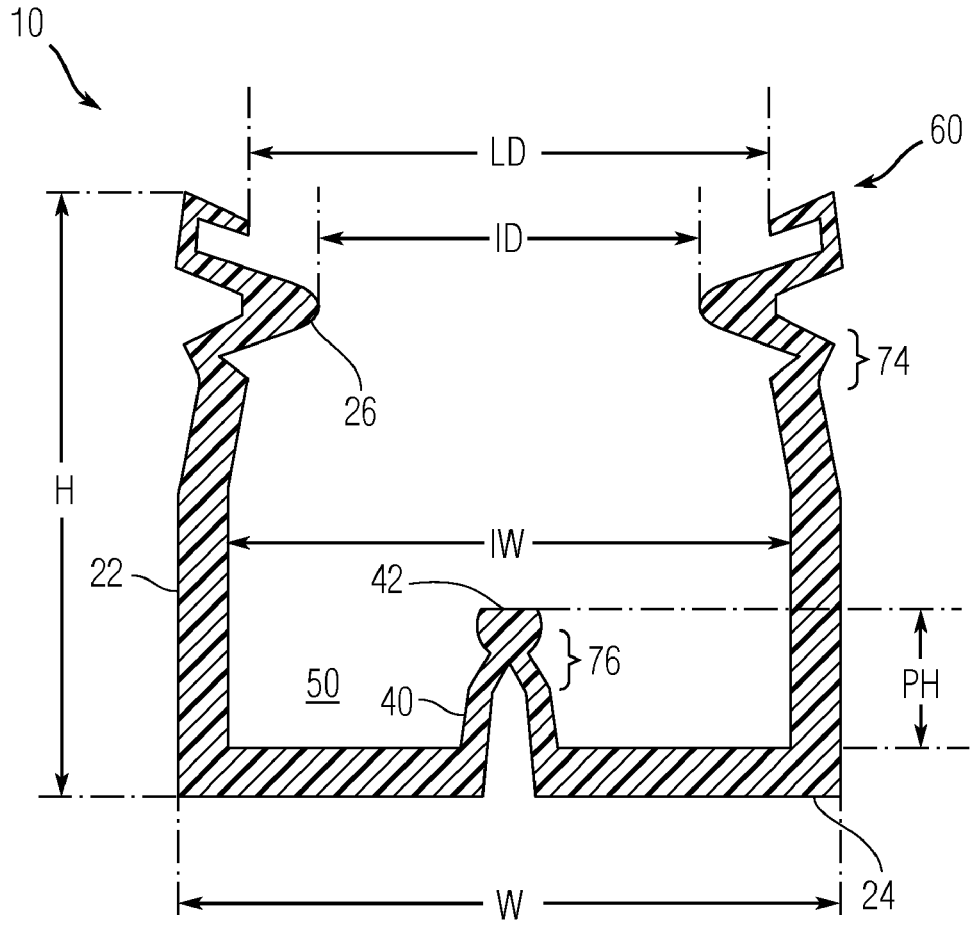
FIG. 6 is a cross-sectional side view of yet another embodiment of the cooling coaster of the present teachings.

As shown in FIG. 6, the cup-like body 20 can incorporate a collapsible fold 74 formed on the cylindrical sidewall 22. The collapsible fold 74 can allow the height of the cooling coaster 10 to increase and decrease as a function of temperature and the state of the coolant in the coolant compartment 50. In addition or in the alternative, the pedestal 40 can incorporate a collapsible fold 76 which can allow the height of the pedestal 40 to increase and decrease as a function of temperature and the state of the coolant in the coolant compartment 50.

The general exterior shape of the cooling coaster 10 will be described with reference to FIGS. 1 and 2. At the closed bottom 24 of the cooler coaster 10, the outside diameter, W, is relatively wide as it forms the base which sits on the resting surface. From the closed bottom 24, the cylindrical sidewall 22 can extend substantially vertically. Moving upwardly, the cylindrical sidewall 22 can begin to taper inwardly towards the sealing ring gasket 26. The sealing ring gasket 26 can form the narrowest portion of the cylindrical cup-shaped body 20. From the sealing ring gasket 26, the outside diameter of the cooling coaster 10 can taper outwardly toward the condensation control rim 60. As a result, the narrowing area in the vicinity of the sealing ring gasket 26 and the widening condensation control rim 60 serve to form a gripping area that can help to allow a user to insert and remove the beverage container 30 from the cooling coaster 10. The cooling coaster 10 has a height, H, that can be measured from the circumferential bottom edge 28 of the closed bottom 24 to the top of the condensation control rim 60 which defines the opening at the top end of the cup-shaped body 20.

As shown in FIG. 4, the exterior surface of the sidewall 22 can be provided with a gripable flap 70. The gripable flap 70 can be used to help the user when inserting and removing the beverage container 30 from the cooling coaster 10. The grippable flap 70 can include apertures for the attachment of identifying indicia, such as one or more JIBBITS®.

The exterior surface of the sidewall 22 can be printed or embossed with advertising, marketing, branding logos and messages. Moreover, the cooling coaster 10 can be made in a variety of colors which can operate to indicate and distinguish ownership when more than one person is drinking the same brand of beverage.

Referring to FIG. 6, the cooling coaster 10 can have the following dimensions when it is to be used with a typical 12-ounce bottle. The overall height, H, of the cooling coaster 10 from the exterior of the closed bottom 24 (the portion which rests on the resting surface) to the top of the condensation control rim 60 can be about 3.000 inches or less, and preferably is about 2.750 inches.

The outside diameter, W, of the cooling coaster 10 can be from about 2.875 inches to about 3.375 inches, and preferably is about 3.125 inches, as measured from the widest extent of the sidewall 22. An inner diameter, IW, can be from about 2.500 inches to about 3.000 inches, and preferably is about 2.750 inches, as measured from the inner portion of the sidewall 22.

From the bottom edge of the closed bottom 24, the cylindrical sidewall 22 can rise about 1.175 inches to about 2.250 inches, and preferably rises about 2.000 inches. The sidewall 22 can then begin to taper inwardly towards the sealing ring gasket 26 that can be located about 2.000 inches to about 2.500 inches, and preferably about 2.250 inches, from the bottom edge of the closed bottom 24. Alternatively, the sidewall 22 can rise at a substantially constant taper from the closed bottom 24 to the sealing ring gasket 26.

The sealing ring gasket 26 can have a height, RG, of from about 0.125 inches to about 0.375 inches, and preferably is about 0.250 inches (see FIG. 2). The inner diameter, ID, at the sealing ring gasket 26 can be about 2.000 inches which can expand to a diameter of about 2.500 inches to about 2.625 inches when a typically-sized beverage container is inserted into the cooling coaster 10. Accordingly, the inner diameter, LD, of the lip 62 of the condensation control rim 60 can be at least about 2.500 inches or larger to allow condensation to flow past the lip 62 and into the interior of the condensation control rim 60. The dimensions of the inner diameter, ID, and of the inner diameter, LD, can be varied depending on the size of the container to be used with the cooling coaster 10. The concave-shape of the closed bottom 24 can rise a distance, CS, of from about 0.150 to about 0.350, and preferably about 0.250 inches from the resting surface at its highest point (see FIG. 2). The closed bottom 24 can have a wall thickness, CB, of from about 0.250 to about 0.500 inches (see FIG. 2). As shown in FIG. 6, the pedestal 40 can rise a distance, PH, of from about 0.500 inches to about 1.000 inches, and preferably about 0.750 inches, from the interior surface of the closed bottom 24.

When a typical 12-ounce bottle or can is inserted into the cooling coaster 10 having the dimensions above, about 1.500 inches of the bottom portion of the container would fit inside of the cup-like body 20 of the cooling coaster 10 when it is resting on the pedestal 40. With respect to other beverages containers, about 2.000 inches or less of the bottom portion of the beverage container would fit inside of the cup-like body 20 of the cooling coaster 10 during use. In other words, the cooling coaster 10 can be sized such that a distance from the stop surface 42 of the support 40 to the opening at the top end of the cup-shaped body 20 is about 2.000 inches, and more preferably, about 1.500 inches. Moreover, a typical 12-ounce bottle would stretch the inner diameter, ID, of the sealing ring gasket 26 from a diameter of about 2.000 inches to about the 2.500 inch diameter width of the bottle when inserted into the cooling coaster 10. A typical 12-ounce can would stretch the inner diameter, ID, of the sealing ring gasket 26 from a diameter of about 2.000 inches to about the 2.625 inch diameter width of the can when inserted into the cooling coaster 10.

The particular size of the cooling coaster 10 depends on the size of the target beverage container 30. For example, a cooling coaster 10 that is intended for use with a 12 oz can and 16-24 oz water bottles may be a different size from one targeting 8 oz bottles, which have a smaller diameter. Likewise, wine bottles would require a substantially larger housing both in diameter and possibly in overall height. The height of the relatively short cup-like housing 20 should be sufficient to allow a bottom portion of a beverage container 30 to fit within it in a sleeve-like fashion while allowing all or a majority of the labeling (or if there is no labeling—the area where labeling could go) to remain uncovered. However, the height of the cup-like body 20 as well as the height of the support 40 can also be varied as necessary or desirable for the particular application.

Prior to inserting the beverage container 30 into the cooling coaster 10, a cooling medium can be placed into the coolant compartment 50. The cooling medium can be ice in the form of various-sized chips or cubes, crushed ice, or can include poured water that is subsequently frozen within the cooling coaster 10. Preferably, the coolant compartment 50 is only partially filled so that the cooling medium does not completely fill the coolant compartment 50. For example, cooling medium can be added up to the level of the top of the support 40 which can act as a visual indicator to show the maximum height for the introduction of the cooling medium. Other known refrigerants can be used as well. Initially, more cooling medium can be added to the coolant compartment 50 by grabbing the cylindrical sidewall 22 of the cooling coaster 10 and stretching it out of contact with the beverage container 30.

In use, after the cooling medium has been added to the coolant compartment 50 of the cooling coaster 10, the cold beverage container 30 is inserted into the cooling coaster 10. The bottom portion of the beverage container 30 is firmly pushed into the open top of the cup-like body 20 and against the sealing ring gasket 26. The resiliency of the sealing ring gasket 26 allows it to expand about the sides of a beverage container 30 to form a water and gas-tight seal therebetween. While gripping the exterior of the cooling coaster 10 with one hand, preferably in the vicinity of the sealing ring gasket 26, the beverage container 30 can then be pushed further into the cooling coaster 10 until the bottom of the beverage container 30 contacts the cooling medium and/or the support 40. The cooling coaster 10 can also be securely held by way of the gripable flap 70. At this point, the cooling coaster 10 is secured to the beverage container 30 via friction and suction and the beverage can be enjoyed at a cool temperature for an extended period of time while controlling condensation.

In an embodiment that incorporates collapsible folds 74, 76 in either or both of the cylindrical sidewall 22 and pedestal 40, respectively, the beverage container 30 is allowed to sink a set distance into the cooling coaster 10 as the cooling medium melts. As melting of the coolant progresses, the sealing ring gasket 26 stays in place with respect to the beverage container 30 while the cylindrical sidewall 22 begins to bulge outwardly due to the melting of the coolant and the pedestal 40 is forced to compress downwardly. The collapsible folds 74, 76 promote the expansion of the sidewall 22 and the compression of the pedestal 40, respectively. In this manner, the beverage container 30 can sink a set distance as the cooling medium melts. For example, a 12-oz beverage bottle can sink approximately 0.500 inches with respect to a resting surface as the coolant melts.

When it is desired to discard the beverage container 30, the cooling coaster 10 can again be gripped with one hand preferably in the vicinity of the sealing ring gasket 26 or by the grippable flap 70 while the other hand grips the beverage container 30 and pulls it away from the cooling coaster 10 and separates it therefrom. At this point, the cooling coaster 10 can be re-loaded with a cooling medium and re-used.

The cooling coaster 10 can be an integral, one-piece structure made from a resilient material. The resilient material should be lightweight, non-porous, printable, elastic, insulating, and resistant to deformation in cold and wet conditions. Other desired characteristics of the resilient material are strength, durability, and being dishwasher safe. The resilient material of the cooling coaster 10 can preferably be an elastomer, foam resin, polymer, thermoset rubber, thermoplastic, although other materials can be employed. More specifically, the resilient material can include polypropylene, neoprene, polyacrylate, olefin, silicone, or urethane. The cooling coaster 10 of the present teachings can be thermoset molded, reaction injection molded, injection molded, or rotational molded, although other production methods may be employed. Most preferably, the cooling coaster 10 of the present teachings can be made by a reaction injection molding system (RIM) and made from a urethane foam, such as, for example, a 245 RIM foam consisting of the reactive mix of polyol and isocyanate.

The cooling coaster 10 of the present teachings provides a stable and protective holder for a beverage container when it is placed on a resting surface. The cooling coaster 10 keeps cold beverages cool for extended periods of time without covering a large portion of the beverage container 30 thereby leaving any label graphics substantially if not entirely exposed which extends the label messaging and improves brand awareness. The cooling coaster 10 limits the amount of condensation, does not leak ice water, and prevents the formation of a wet ring on the resting surface.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A cooling coaster comprising:

a cup-shaped body comprising a closed bottom and a cylindrical sidewall forming an opening at a top end thereof;

a sealing ring gasket forming a portion of the cylindrical sidewall of the cup-shaped body in a vicinity of the opening and forming a water and gas-tight seal when a beverage container is inserted into the cup-shaped body; and an elongated support pedestal having a length and a width with the length being greater than the width, the elongated support pedestal extending along its length from the closed bottom into an interior of the cup-shaped body, a distal end of the support pedestal forming a stop surface such that when the beverage container is inserted into the cup-shaped body (i) the stop surface acts as an insertion limit for the beverage container and (ii) a coolant compartment capable of receiving a coolant is formed within the cup-shaped body underneath the beverage container:

wherein a distance from the stop surface of the support pedestal to the opening at the top end of the cup-shaped body is about 2 inches or less.

2. The cooling coaster of claim 1, wherein the distance from the stop surface of the support pedestal to the opening at the top end of the cup-shaped body is about 1.5 inches or less.

3. The cooling coaster of claim 1, wherein the cooling coaster is an integral, one-piece structure formed as a single piece.

4. The cooling coaster of claim 1, further comprising a condensation control rim formed at the opening of the cup-shaped body.

5. The cooling coaster of claim 1, wherein the cylindrical sidewall includes a collapsible fold.

6. A cooling coaster comprising;

a cup-shaped body comprising a closed bottom and a cylindrical sidewall forming an opening at a top end thereof;

a sealing ring gasket arranged in the cylindrical sidewall of the cup-shaped body in a vicinity of the opening; and a support pedestal extending from the closed bottom into an interior of the cup-shaped body, a distal end of the support pedestal forming a stop surface;

wherein a distance from the stop surface of the support pedestal to the opening at the top end of the cup-shaped body is about 2 inches or less; and wherein the support pedestal includes a collapsible fold.

7. A cooling coaster comprising:

a cup-shaped body including a closed bottom and a cylindrical sidewall forming an opening at an end thereof;

a sealing ring gasket forming a portion of the cylindrical sidewall and situated a set distance below the opening formed by the cylindrical sidewall, the sealing ring gasket forming a narrowest portion of the cup-shaped body and forming a water and gas-tight seal when a beverage container is inserted into the cup-shaped body; and wherein a distance corresponding to a height of the cooling coaster as measured from the closed bottom to the opening at the end of the cylindrical sidewall is about 3 inches or less.

8. The cooling coaster of claim 7, wherein the cooling coaster is an integral, one-piece structure formed as a single piece.

9. The cooling coaster of claim 7, wherein the cylindrical sidewall includes a collapsible fold.

10. The cooling coaster of claim 7, further comprising a support extending into an interior of the cup-shaped body and forming a stop surface arranged a set distance from the closed bottom such that when the beverage container is inserted into the cup-shaped body the support acts as an insertion limit for the beverage container and a coolant compartment capable of receiving a coolant is formed underneath the beverage container in an area between the closed bottom and the stop surface of the support.

11. A cooling coaster comprising:

a cup-shaped body including a closed bottom and a cylindrical sidewall forming an opening at an end thereof;

a sealing ring gasket integrally formed with the cylindrical sidewall in a vicinity of the opening, the sealing ring gasket forming a narrowest portion of the cup-shaped body and being capable of forming a water and gas-tight seal when a beverage container is inserted into the cup-shaped body; and a support extending into an interior of the cup-shaped body and forming a stop surface arranged a set distance from the closed bottom, an area between the closed bottom and the stop surface of the support forming a compartment capable of receiving a coolant;

wherein a distance corresponding to a height of the cooling coaster as measured from the closed bottom to the opening at the end of the cylindrical sidewall is about 3 inches or less; and wherein the support includes a collapsible fold.

12. The cooling coaster of claim 10, wherein the support is a pedestal that extends from the closed bottom of the cup-shaped body, the pedestal including a distal end forming the stop surface.

13. The cooling coaster of claim 7, further comprising a condensation control rim formed at the opening of the cup-shaped body.

14. A cooling coaster comprising:

a cup-shaped body comprising a closed bottom and a cylindrical sidewall forming an opening at a top end thereof;

a sealing ring gasket forming a portion of the cylindrical sidewall in a vicinity of the opening and forming a water and gas-tight seal when a beverage container is inserted into the cup-shaped body; and a support pedestal extending from the closed bottom into an interior of the cup-shaped body, a distal end of the support pedestal forming a stop surface such that when the beverage container is inserted into the cup-shaped body (i) the stop surface acts as an insertion limit for the beverage container and (ii) a coolant compartment capable of receiving a coolant is formed within the cup-shaped body underneath the beverage container;

wherein at least one of the cylindrical sidewall and the support pedestal include a collapsible fold.

15. A cooling coaster comprising:

a cup-shaped body comprising a closed bottom and a cylindrical sidewall forming an opening at a top end thereof;

a sealing ring gasket arranged in the cylindrical sidewall in a vicinity of the opening; and a support pedestal extending from the closed bottom into an interior of the cup-shaped body, a distal end of the support pedestal forming a stop surface;

wherein each of the cylindrical sidewall and the support pedestal include a collapsible fold.

16. The cooling coaster of claim 14, wherein the cooling coaster is an integral, one-piece structure formed as a single piece.

17. The cooling coaster of claim 14, further comprising a condensation control rim formed at the opening of the cup-shaped body.

* * * * *